United States Patent [19]

Coffey

[11] 3,939,578

[45] Feb. 24, 1976

[54] EDUCATIONAL BOARD GAME APPARATUS

[76] Inventor: Elizabeth Jane Putnam Coffey, 1322 6th St., Coachella, Calif. 92236

[22] Filed: June 20, 1973

[21] Appl. No.: 137,278

[52] U.S. Cl. ..... 35/9 R; 35/69; 273/134 AD; 273/134 C

[51] Int. Cl.[2] ..... G09B 3/00

[58] Field of Search ..... 273/134; 35/9

[56] References Cited

UNITED STATES PATENTS

| | | | |
|---|---|---|---|
| 422,682 | 3/1890 | Young | 35/71 UX |
| 1,635,734 | 7/1927 | Ziegler | 273/134 AC |
| 1,635,735 | 7/1927 | Ziegler | 273/141 R X |
| 2,026,082 | 12/1935 | Darrow | 273/134 AD |
| 2,717,157 | 9/1955 | Dylewski | 273/134 AC |
| 3,367,662 | 2/1968 | Charles et al. | 273/134 AD |
| 3,469,845 | 9/1969 | Grow | 273/134 AD |
| 3,565,437 | 2/1971 | Mitchell | 273/134 AD |

FOREIGN PATENTS OR APPLICATIONS

| | | | |
|---|---|---|---|
| 169,289 | 10/1951 | Austria | 35/9 E |
| 184,517 | 8/1922 | United Kingdom | 273/134 AC |

*Primary Examiner*—Delbert B. Lowe

[57] ABSTRACT

A board apparatus that is comprised of a plurality of diverse game sets, each game set containing a plurality of game board units; each embodying a game board, with a peripheral area containing a closed rectangular path constituting a continuous playing course; playing tokens which are advanced by dice; the squares comprising the playing course are individually identified by color and arranged in a repeated color sequence, the color indicating that the player is to respond to a question, command, symbol, or name on the top card from a specific set of cards, and the course is interrupted by squares which indicate a forfeiture of turn. Each game board contains an enclosed central area which is designed to help the players with responses. The enclosed central area contains printed matter, pictures, diagrams, and other subject matter. Each game board unit contains a plurality of card sets placed between the peripheral area and the enclosed central area of the game board, each set of cards relating to either a specific area of the subject of the game board or a specific area of the enclosed central area of the game board. Each card, within a set of cards, is marked with the same color, corresponding to a color on the playing course. Each card in each set of cards contains a plurality of questions, commands, symbols, and/or names in any combinations on the face side and the corresponding responses on the reverse side of the card.

4 Claims, 11 Drawing Figures

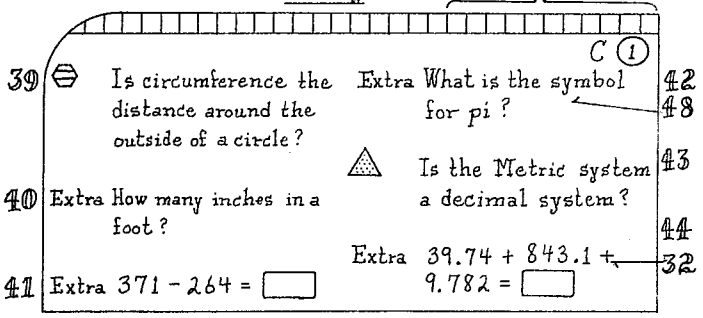
FIG. 6.
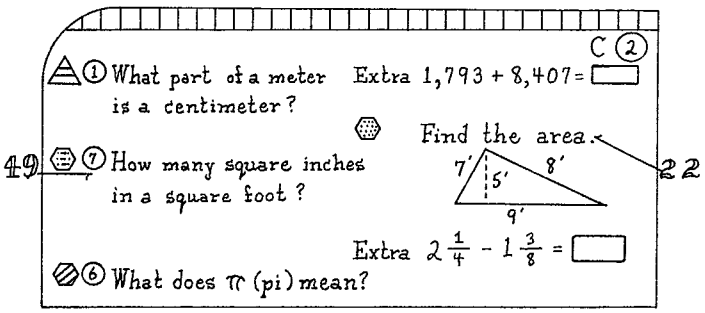
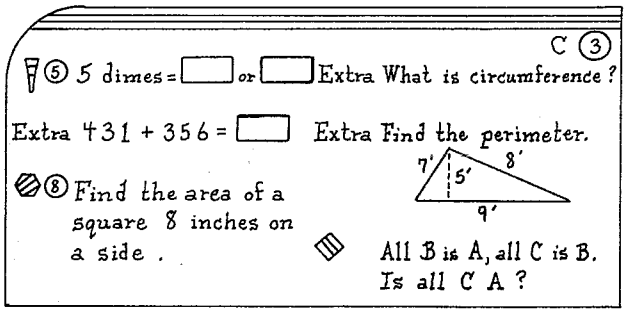
FIG. 5.
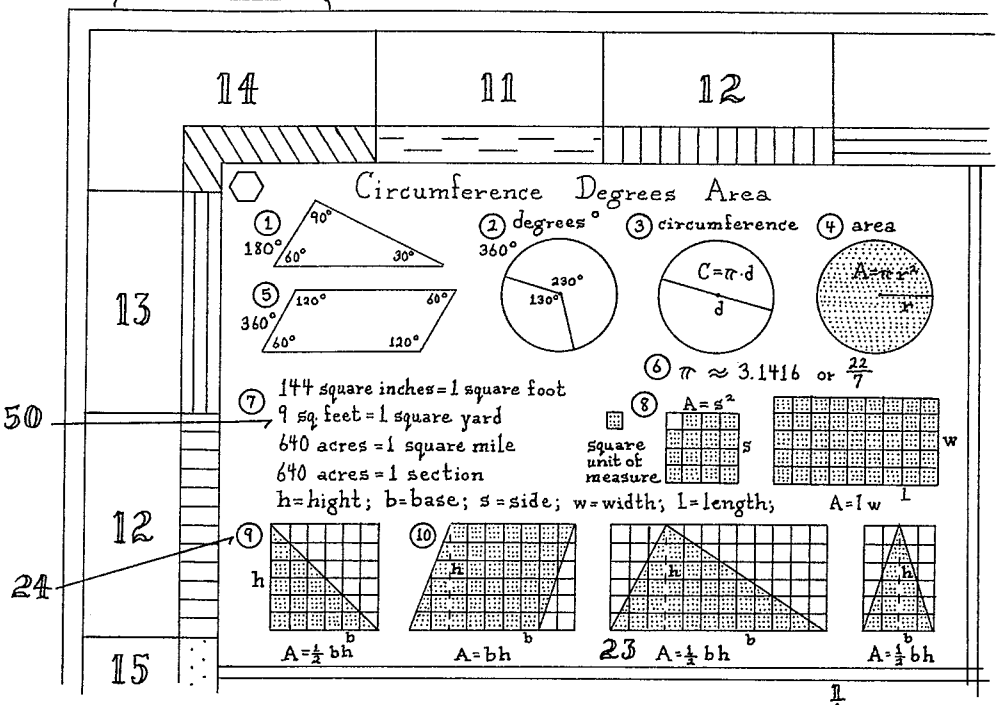
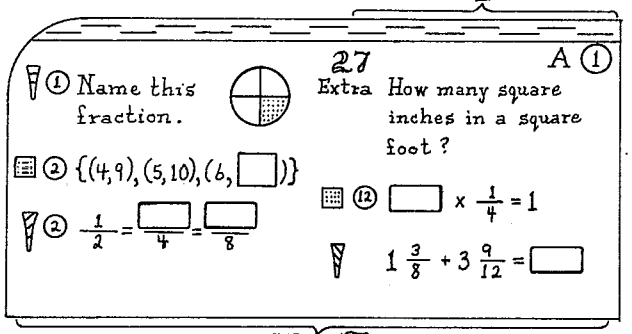
FIG. 7.
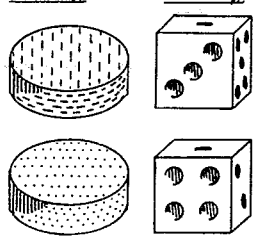
FIG. 8.
FIG. 9.

EDUCATIONAL BOARD GAME APPARATUS

SUMMARY OF THE INVENTION

This game is designed to be completely tutorial within the structure of the game and needs no supervision. Tutorial means each player begins study where he needs to, proceeds to learn material at his own speed, and learns as much as he is capable of learning. Also, tutorial means, in this game, a diverse group can learn at the same time as individuals.

DETAIL OF THE INVENTION

With the above description in mind, this invention can be more clearly understood when read in conjunction with the attached drawings wherein.

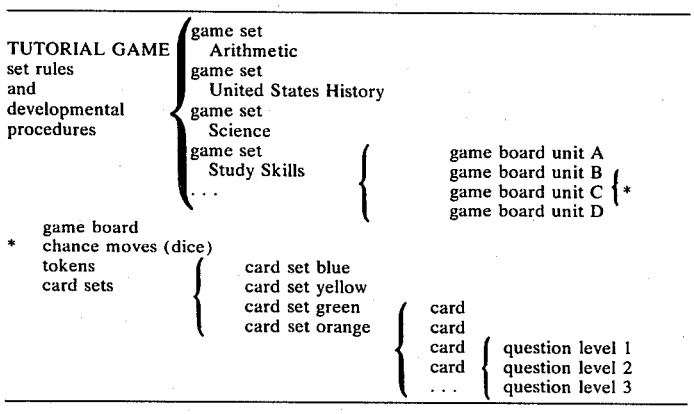

Tutorial Game is a developmental procedure and has set rules designed to create a tutorial system of learning by creating levels of study. The game is divided into diverse game sets, each devoted to a subject. Each game set is divided into game board units, each dealing with diverse areas of the game set subject. Each game board unit is composed of a game board, chance moves (dice), tokens, and card sets. The card sets are composed of cards divided equally into a given number of sets. Each card contains question levels, and the question levels are in a progression, this progression creating levels of study. There are three types of progression: horizontal, vertical, and horizontal-vertical. This progression leads to levels of study, from three to twelve in each game set. A level of study contains like ability units of subject matter. Each succeeding level of study builds upon skills, concepts, methods, observations, vocabulary words, and/or facts learned in the preceding level or levels and prepares the player for the next level. Players soon find the level of study that corresponds to their ability and proceed from that level of study through the game board units and through the question levels at their own rate of learning. Boredom and desire to learn keep the player moving forward through the game set. Failure keeps the player from moving too fast. The competition provides a motive for disinterested players. Players who learn slowly can get the necessary practice by playing the same game board unit at the same question level over and over, while players who learn fast can go rapidly from level of study to level of study. Players can be paired by personality, regardless of ability or age, due to the different levels of study within the same game board unit, each player having equal opportunity to win.

Figure 4:
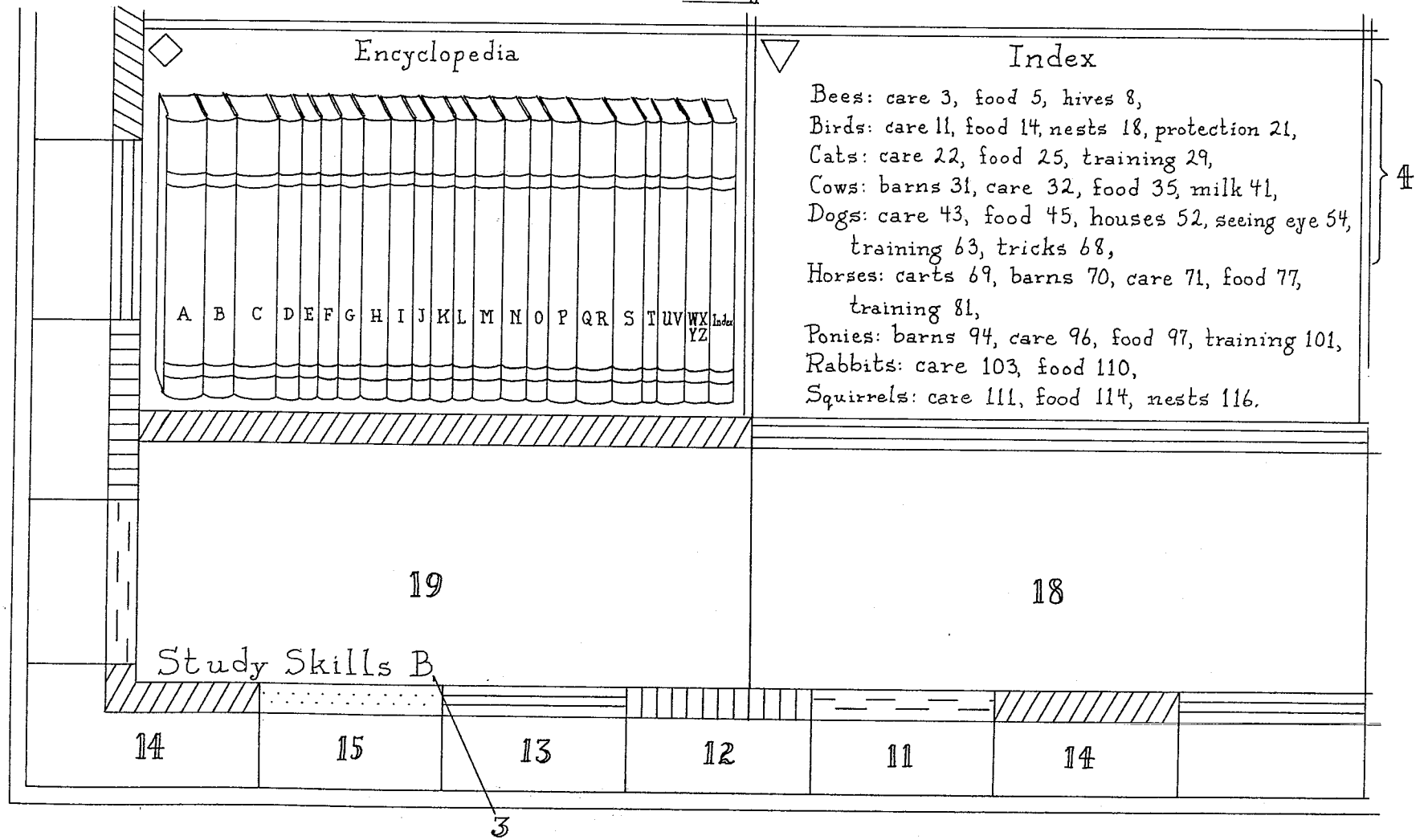
Figure 10:
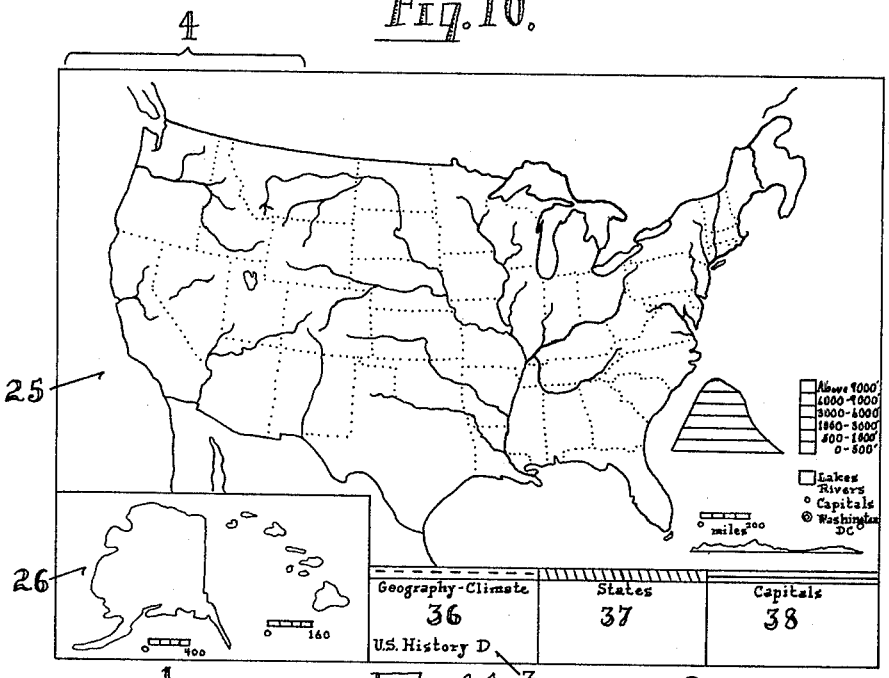
Figure 11:
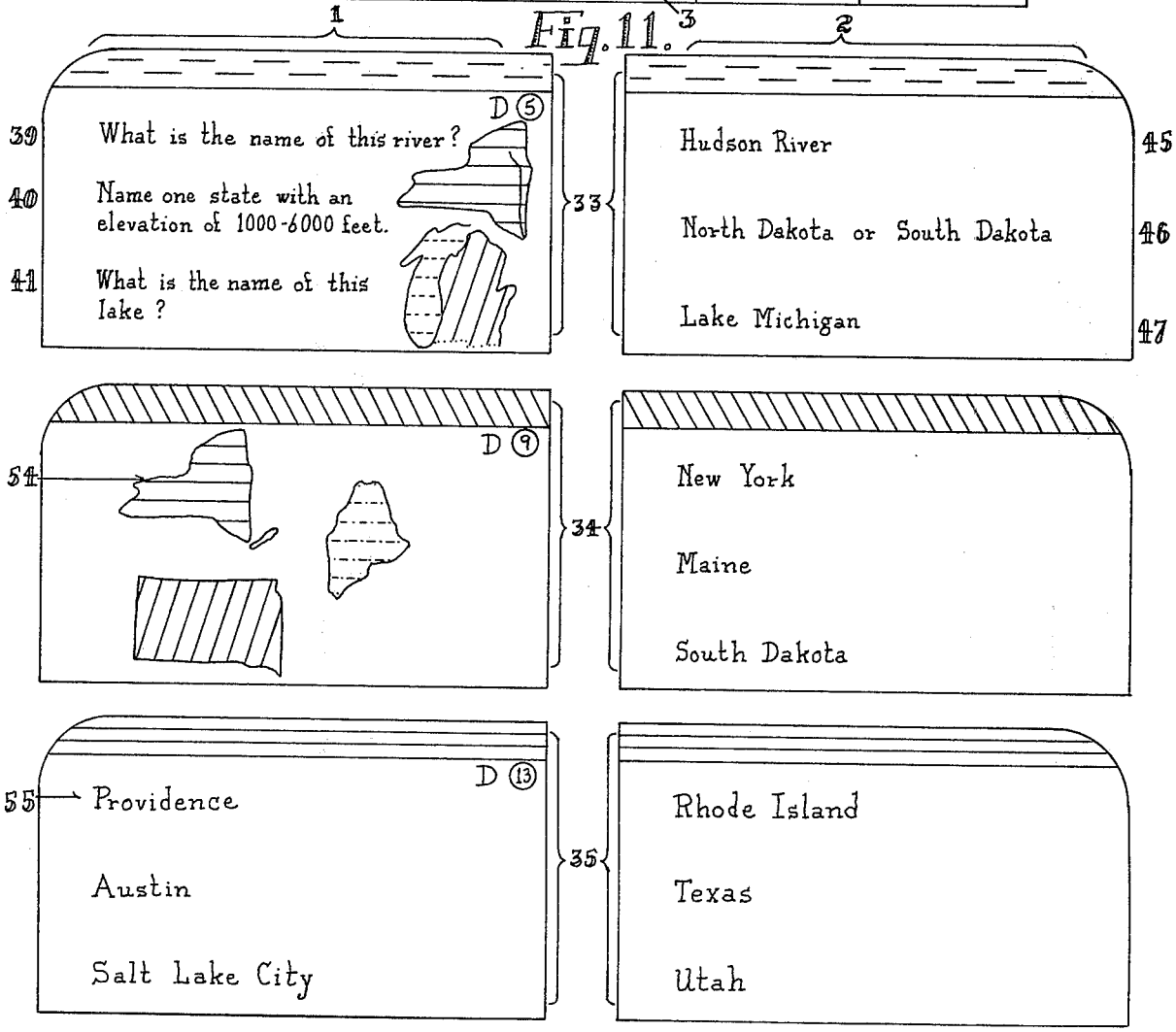

FIG. 4 is a representative view of the lower left hand corner of a different game board at 4, in the game set Study Skills;

FIG. 5 is a representative view of the upper left hand corner of one game board at 4, in the game set Arithmetic;

FIG. 6 is a representative view of the faces of three cards from a game board unit, the game board being shown at 4 in FIG. 5;

FIG. 7 is a representative view of the face of one card from a different game board unit in the game set Arithmetic;

FIG. 8 is a representative view of one means of determining chance moves;

FIG. 9 is a representative view of a possible form of the tokens;

FIG. 10 is a representative view of the enclosed central area of a game board at 4;

FIG. 11 is a representative view of one card each from the plurality of card sets that belong to the same game board unit as the game board shown at 4 in FIG. 10.

Referring now in greater detail to the drawings wherein like reference numerals refer to like parts throughout the different figures, this game, called "Tutorial Game," is a number of diverse game sets, each covering different subjects, each being played by the same system of play or set rules, and each being developed using the same procedure. Under the game framework of Tutorial Game, there can be a series of game board units dealing with the subject science and called the game set Science, or there can be a series of game board units dealing with the subject European history and called the game set European History, or there can be a series of game board units dealing with almost any subject.

Figure 1:
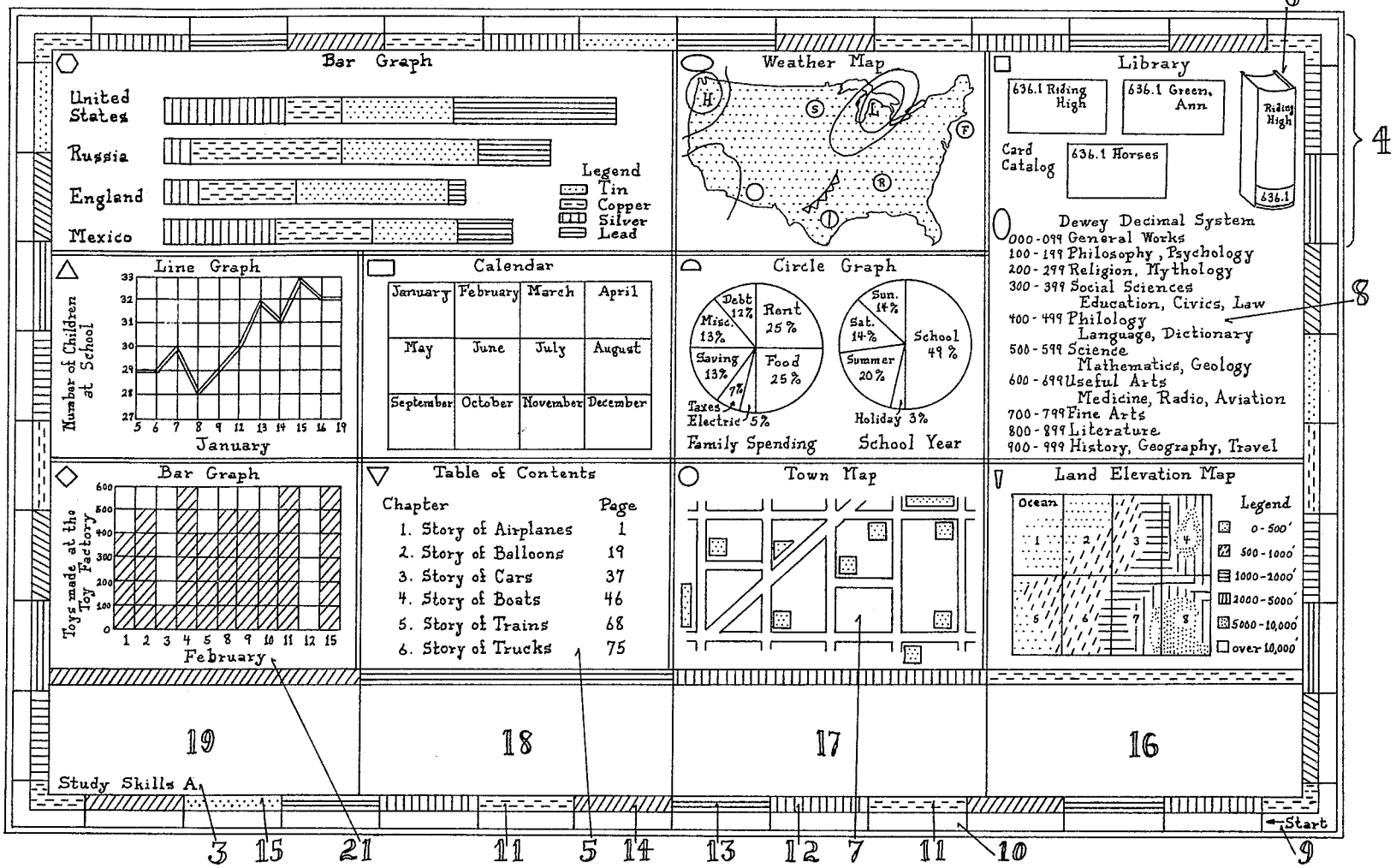
FIG. 1 is a representative view of a game board at 4.

Each game set, whether Arithmetic, Science, History, or other, can be a series of diverse game board units. A game board unit consists of a game board, a representative view being shown at 4 in FIG. 1; card sets, marked with the same letter as the letter at 3 on board 4 in FIG. 1, members being represented in FIG. 2, a method of chance placement on the playing course being represented by FIG. 8; and tokens, that stand for the players on the game board, being represented by FIG. 9. FIG. 1 at 4 is a representative view of game board A from the game board unit A in the game set Study Skills. This game board unit can cover the following diverse areas of the subject study skills, bar graphs, single line graph, calendar, table of contents, weather map, town map, land elevation map, circle graph, card catalog, and Dewey Decimal System. FIG. 4 at 4 is a partial representative view of game board B from the game board unit B in the game set Study Skills. This game board unit can cover the following areas of the subject study skills: encyclopedia, index, time, dictionary, exploration map, acquisition map, multiple line graphs, rainfall map, and world map. Game board units C and D in the game set Study Skills (not illustrated) also embody diverse areas of the subject study skills. No game board unit in any one game set should cover the exact same area of the subject as any other game board unit in that game set.

The game board units in a game set can succeed in any given order. In the game set Study Skills, game board unit A is no more first than is game board unit C. The game board units are lettered solely to distinguish between them. In the game set Arithmetic, one game board unit does come first but is it distinguished from the other game board units in the game set by being called "Starter Set".

The game board units in a game set are connected to each other by a relationship. Part of the relationship is the subject matter covered, all game board units in the game set Study Skills dealing with some area of that subject; but the horizontal and horizontal-vertical progressions of questions (for clarity, questions, commands, symbols, or names, henceforth will be called questions, except as important distinctions are needed) also cause a relationship. In any given game set, at any given question level, the player can and should play all game board units because the questions are dependent upon the question progression. Only in cases of past uneven learning or very high intelligence should a player be allowed to use different question levels on different game board units within the same game set. This point cannot be over emphasized because of the delicate nature of the question progression. This progression makes it possible for players to be paired by personality rather than ability. That is, players that get along together or are friends can play with each other even if their abilities are quite different. Or players can play with anyone they wish. A player that learns slowly can play a given game board unit at question level 1 with a player that learns more rapidly who is playing the same game board unit at question level 2 or 5 or any other level. Either player has the same chance of winning the contest. Also, a player who learns slowly can profit by hearing the advanced player answer (terms "answer" and "response" being used interchangeably) his questions.

All of the game board units in any given game set can be used at the same time. A player at any given question level can play any game board unit in the game set. The player does not need to play the game board units in any given order, excepting Arithmetic. Nor does the player need to play any game board unit to the exclusion of any other game board unit. In other words, anytime the player plays he can play any game board unit he wishes or is assigned to play, at his question level. All or some of the game board units in a game set can be played at the same time by different groups of players. Also, all or some of the game board units in any game sets can be played at the same time by different groups of players. Players may be at different question levels in different game sets. Each game board unit has a winner at the end of play.

Each and every game board unit contains a game board. A game board is a flat surface made of any material, a representative view being at 4 in FIG. 1 and partial representative views being at 4 in FIGS. 4, 5, and 10. The boards contain printed matter as at 5 in FIG. 1, pictures as at 6 in FIG. 1, maps as at 25 in FIG. 10, diagrams as at 7 in FIG. 1, and/or subject matter as at 8 in FIG. 1; and are used in the playing of a game. The game boards in this game are designed for two important functions. First, the game board contains the system of play. Around the peripheral area is a closed rectangular path constituting a continuous playing course, starting at 9 in FIG. 1 and continuing clockwise through 9 continuously. The squares comprising the playing course at 10 are individually identified by color at 11, and arranged in a repeated color sequence at 11, 12, 13, 14, 11, . . . ; and interrupted by squares indicating a forfeiture of turn at 15, the colors indicating that the player is to respond to a question on the top card from a specific set of cards. Players landing, by chance, upon square 10 marked with color 11 would answer their level question from the top card in the set of cards located at 16 in that game board unit because the square and the card set have the same color coding; players landing upon 12 answer their level question from the top card in the set of cards located at 17 in that game board unit; players landing at 13 answer their level question from the top card in the set of cards located at 18 in that game board unit; players landing at 14 answer their level question from the top card in the set of cards located at 19 in that game board unit; and players landing at 15 cannot answer any questions.

Second, the game board is designed to show answers to questions. At 20 in FIG. 2, card face 1, "What month is this bar graph about?", the answer can be determined by looking at 21 in FIG. 1. Methods of determining answers to questions, e.g., at 22 in FIG. 6, card face 1, "Find the area.", the answer can be determined by using the equation at 23 in FIG. 5; questions to be answered at 24 in FIG. 5, "What is the area of 9?"; general over-all concepts about the subject, "The United States lies between two oceans.", at 25 in FIG. 10; and/or pictures which help supply answers to questions or create over-all impressions about the subject, "Alaska and Hawaii are not part of the continental United States.", at 26 in FIG. 10. The game board can supply answers to questions in other game board units in the same game set, e.g., at 27 in FIG. 7, "How many square inches in a square foot?" appears on game board C as shown at 50 in FIG. 5, and is asked in question form on a card belonging to game board A at 27 in FIG. 7. Also, the game board is designed to attract players through color, size, and/or spacing and arrangement.

Each and every game board unit contains a method of chance placement on the playing course. Dice are shown in FIG. 8, but any method of chance placement can be used.

Each and every game board unit contains tokens, represented in FIG. 9, which represent the players on the playing course, each token being easily identified by a different color or shape from all other tokens on the game board.

Each and every game board unit contains sets of cards. A card is a flat surface which has printing on one or both sides and is designed to be used as part of a game apparatus. The cards in this game are located under the subject they cover in from three to four card sets, and are placed in the card area at 16, 17, 18, and possibly at 19, in FIG. 1; or the card sets are located according to subject matter in from three to four sets of cards, and are placed in the card area at 36, 37, 38, and possibly at 38*a* (a fourth area not illustrated), in FIG. 10. The number of cards per game board unit depends upon the curriculum and the nature of the subject.

Curriculum emphasis is controlled by the number of game board units in a game set, the number of cards in a game board unit, the number of questions in a subject area, and/or the size of the game board space devoted to the subject. These factors can differ considerably from one game set to another and from one game board unit to another within the game set.

Also, the number of cards depends upon the nature of the subject. If it is desirable for the players to memorize answers, then only a few cards containing only a few question levels should go with that game board unit. The game board unit represented by the game board at 4 in FIG. 10 contains only seventeen cards in each of three sets, for a total of fifty-one cards or one hundred and fifty-three questions. If it is undesirable for players to memorize answers and desirable for them to learn skills and/or processes instead, then large but manageable amounts of cards are needed in that game board unit, with many question levels on each card. The game board unit represented by the game board shown at 4 in FIG. 1 contains twenty-five cards in each of four sets of cards, for a total of one hundred cards or three hundred questions. The game board unit represented by the partial game board at 4 in FIG. 5 contains 25 cards in each of four sets of cards, for a total of 100 cards or 600 questions.

All cards in a game board unit are color coded. Each card, within a set of cards, is marked with the same color, corresponding to a color on the playing course. Each set of cards is marked with a different color to distinguish it from the other sets of cards. There are two types of color coded cards, depending upon the nature of the subject for any particular game board unit. Most often cards are colored to match the game board area dealing with the same subject, cards at 31 in FIGS. 2 and 3 belonging in a set of cards in area 19 on the game board 4 in FIG. 1; these cards contain questions covering bar graphs and line graphs, the game board area just above the card set. The card set at 18 in FIG. 1 contains questions covering bar graph, calendar, and table of contents. The card set at 17 in FIG. 1 contains questions covering weather map, circle graph, and town map. The card set at 16 in FIG. 1 contains questions covering library, Dewey Decimal System, and land elevation map. A few questions will be on cards that are not directly below their subject area on the game board. This is necessary for review and curriculum emphasis. (See 32 in FIG. 2 and FIG. 6). This type of color coded card contains a symbol in front of almost all questions. The symbol tells the player what area of the game board to refer to when looking for the answer or the method of arriving at the answer. Some cards have a circled numeral next to the symbol as at 49 in FIG. 6, this circled numeral telling the player where to look in the symboled area. Some questions simply have "Extra", as at 27 in FIG. 7, written before them, this means there is no game board area to help the player. These questions are review or curriculum emphasis questions.

In the game board units in some game sets, the cards are color coded and placed on the game board according to a division of the subject matter of the game board unit. In FIG. 11, the card at 33 covers the subject division "geography-climate" and goes in area 36 on the game board at 4 in FIG. 10; the card at 34 covers the subject division "states" and goes in area 37 on the game board at 4 in FIG. 10; and the card at 35 covers the subject division "capitals" and goes in area 38 on the game board 4 in FIG. 10. The cards shown at 33, 34, and 35 in FIG. 11 are representative of the card sets that are placed on a game board according to the subject division covered. These cards are not below the subject area on the game board.

Figure 2:
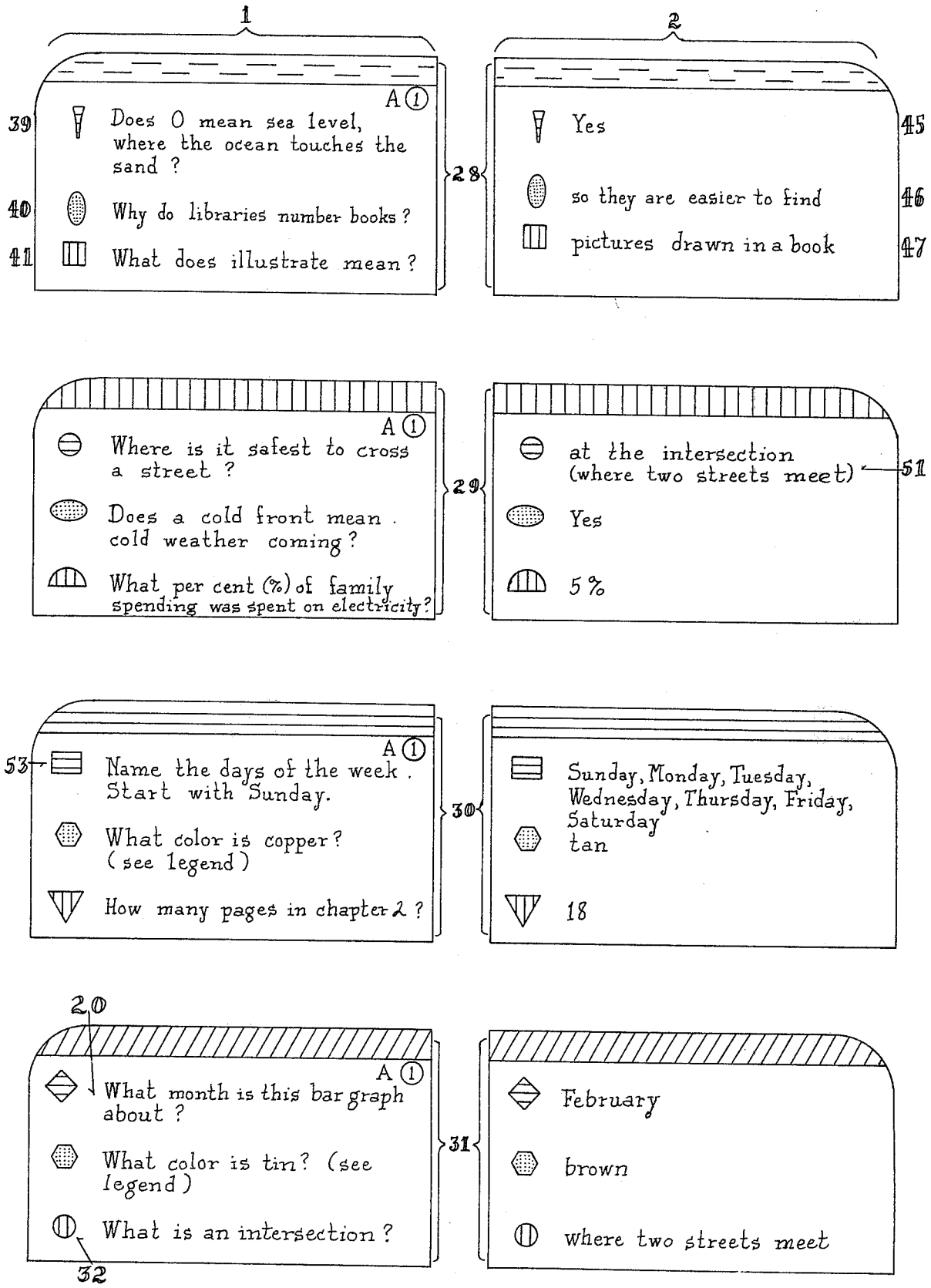
FIG. 2 is a representative view of one card each from the plurality of card sets that belong to the same game board unit as the game board shown at 4 in FIG. 1.
Figure 3:
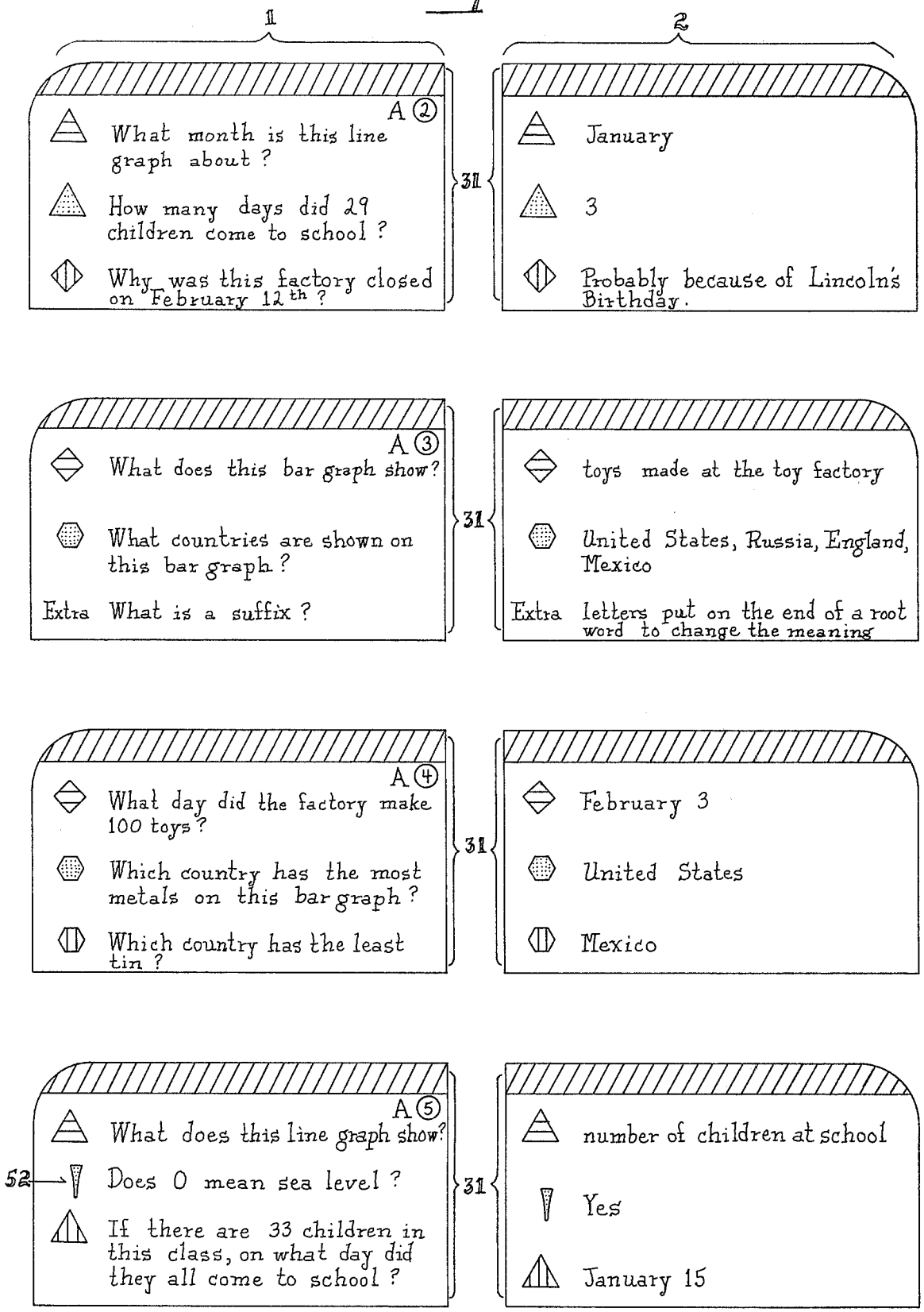
FIG. 3 is a representative view of four cards from the same set of cards that belong to the same game board unit as the game board shown at 4 in FIG. 1.

All color coded cards in all game board units, in all game sets, contain from one to six questions in any combinations on one side of the card as at 39, 40, and 41 in FIG. 2; and at 39, 40, 41, 42, 43, and 44 in FIG. 6; and the corresponding responses on the reverse side of the same card, as illustrated by response 45 for question 39, response 46 for question 40, and response 47 for question 41, in FIG. 2. All of these questions are color coded, and all symbols in front of the questions are color coded. Question level one, at 39 on card 28 at 1 in FIG. 2, is printed in green ink, as is the associated symbol. The response at 45 on the reverse side of card 28 at 2 in FIG. 2 is likewise printed in green ink, as is the associated symbol. Question level two, at 40 on card 28 at 1 in FIG. 2, is printed in tan ink as is the associated symbol. The response at 46 on the reverse side of card 28 at 2 in FIG. 2 is likewise printed in tan ink, as is the associated symbol. Question level three, at 41 on card 28 at 1 in FIG. 2 is printed in violet ink, as is the associated symbol. The response at 47 on the reverse side of card 28 at 2 in FIG. 2 is likewise printed in violet ink, as is the associated symbol. The word "Extra" is always printed in the ink color for that particular question level. Not only are all symbols that direct the player to a game board area color coded, and the printing color coded for each question, but any symbols that are part of a question are also color coded, as at 39 at 1 in FIG. 11, the state of New York being colored green for a question on level one, while the river is colored blue. Questions which take the form of symbols as at 54 in card 34 at 1 in FIG. 11, are also color coded, green in this instance because it is question level one. Questions which take the form of commands, as at 53 on card 30 at 1 in FIG. 2, are also color coded, green in this instance because it is question level one. Questions which take the form of a name, as at 55 in card 35 at 1 in FIG. 11, are also color coded, green in this instance because it is question level one. Any color can be used to denote the different question levels as long as the levels can be distinguished one from another.

The questions contained on the cards are in progression horizontally, vertically, and horizontally-vertically. This progression, or moving forward in a continuous and connected series of steps, is determined by difficulty of the material, time sequence, dependency of knowledge built upon knowledge, nature or character of facts, and/or nature of the process being learned, and it creates levels of study. Levels of study are like ability units of study. These levels of study are least difficult from game board unit to game board unit within the same question level, called horizontal progression. The question at 27 in FIG. 7 on game board unit A is in horizontal progression with the question at 48 in FIG. 6 on game board unit C. The levels of study within a game board unit, in different question levels, called vertical progression, are more difficult. The question at 39 in FIG. 6 is in vertical progression with the question at 40 in FIG. 6, and with all other questions on that particular subject area in more difficult question levels on that game board unit. The most difficult levels of study are in horizontal-vertical progression. This progression is in different game board units in different question levels within the same game set. A question level in one game board unit prepares the player for a later question level in another game board unit. The question at 49 in FIG. 6 is in horizontal-vertical progression with the question at 27 in FIG. 7. It is absolutely necessary that players be or become proficient at each question level before progressing to the next level. Levels of study in the same question level can be moved through by the players at any time because the questions are not that much more difficult. These levels of study within question levels do teach considerable skills, processes, and facts, but the degree of difficulty is controlled by the information contained on the game board. No question progression exists between game sets.

The responses contained on the reverse side of the card are for the most part perfectly normal responses to questions; however, two types are treated differently in this game. The response at 51 in card 29 at 2 in FIG. 2 is considered correct if only the portion out of the parentheses is given. The player may include the part in the parentheses if he so chooses. The response at 46 in card 33 at 2 in FIG. 11 is considered correct if only one state is named. The player may include more than one state if he so chooses.

This game contains a success factor. The success factor is the proportion of questions a player can answer correctly as opposed to the number of questions the player cannot answer correctly. A normal success factor ratio is two to one, that is, two questions the player can answer correctly when they are presented as opposed to one question that the player cannot answer correctly when it is presented and must learn the answer for from the answer on the reverse side of the card. With this ratio the player feels he is succeeding and wants to play the game over and over again. This success ratio does not need to remain the same for all game board units or for all game sets. To assure a player's success, five techniques are used: questions are written so that the answer is obviously yes, as at 39 in card 28 at 1 in FIG. 2, the player can see the answer on the game board as at 50 (top entry in area 7) in FIG. 5 and learns by repetition at 49 in FIG. 6, the player can see the process on the game board, at 23 in FIG. 5, by which to compute the answer and learns by practice at 22 in FIG. 6, the player is asked questions from a preceding question level or levels but not necessarily from the same game board unit, as at 27 in FIG. 7, and/or the player is asked to answer a question the answer for which was contained either in the answer to another question, as at 51 on card 29 at 2 in FIG. 2 and the question at 32 on card 31 at 1 in FIG. 2, or in another question at 39 on card 28 at 1 in FIG. 2 and the question at 52 on card 31 at 1 in FIG. 3. When the subject matter is such that it is desirable for a player to learn by memory, then the question is asked so that the player cannot see the answer or see how to arrive at the answer, as at 53 on card 30 at 1 in FIG. 2. The player must know the answer or learn the answer from the reverse side of the card. If the subject matter is such that it is desirable for the player to learn a study skill, an observation skill, or a computation process, then the answer is on the game board or the process for determining the answer is on the game board.

This game contains an excuse for losing factor. The excuse for losing factor is a means by which a player, who is successful because of the success factor, can explain to himself and others why someone else earned more cards and won the contest. This factor enables the player to play the game board unit again and again even though someone else wins most of the time. On each game board, a certain per cent of the color coded squares are black, as at 15 in FIG. 1. When the player, by chance, lands on a square that is connected with a black color he cannot answer any question. Therefore, if he loses the contest he can say it was because he landed on too many black squares.

The game board units in the game sets called Tutorial Game are as simple to play as they are complicated to create.

Two or more players obtain a game board unit, and place it on any flat surface. They place the card sets in their respective color dominated areas. Only the face of the top card is visible in each set of cards.

Each player selects his token and places it upon "start" at 9 in FIG. 1.

Each player selects his question level. A beginning player would select question level one or green, as at 39 in 1 in FIG. 2. A player who is proficient at question level one, or green, would select question level two, or tan, as at 40 in 1 in FIG. 2. A player who is proficient at question level two, or tan, would select question level three, or violet, as at 41 in FIG. 2. These examples are only representative. If more than three question levels exist in a game, as shown in FIG. 6, the player chooses his question level using the above described method. No player may change question levels during play.

Since the playing course around the peripheral area is without a terminal point, the players must decide upon a time limit: one class period, three rounds of the game board playing course, first player to earn twenty-five cards, when one card set is depleted, or any agreed upon limit. Play may also terminate at any time upon mutual consent of the players.

After the card sets have been placed in the appropriate card area, each player has selected his token and placed it upon "start," each player has selected his question level, and a time limit has been set, each player throws a die or dice, or uses any method of determining chance placement on the playing course. The player with the highest number goes first. In case of a tie, players throw a die or dice again. The player who goes first throws the die or dice again and moves his token the dictated number of spaces.

Should the player throw a six, he moves his token six squares to 13 in FIG. 1. The color coded space at 13 in FIG. 1 dictates that the player must answer his question level on the top card of the set of cards located at 18 in FIG. 1. After the question has been answered, the player turns the card to the reverse side 2 in FIG. 2, and checks the correct answer. If the player's answer is correct, the player removes the card from the set and retains it until the end of play. If the player's answer is incorrect, the card is placed under the other cards in its set of cards. Parts of the answer in parentheses do not count. The answer is correct if only the part out of parentheses is given. But the player may give the complete answer if he wishes. Answers containing the word "or" are considered correct if only one of the alternatives is given by the player.

After the other player or players have taken their turns as described above, this player roles the die or dice again and, commencing from square 13 in FIG. 1, moves the number of squares dictated by the dice. Each player in turn proceeds around the playing course in this manner. Moves rotate clockwise among the players.

If player lands on a square with black, as at 15 in FIG. 1, he does not get to answer any question. He must forfeit this turn and wait until his next turn to answer a question or make a response.

If any card set should become depleted before the game terminates, a player landing on a square with that color code can choose a card from any other card set.

No player can touch the cards or card sets until the question is answered.

The player with the most cards at the end of play wins.

A variation of the game is to have the players answer two or more of the questions on the card, in order to earn it. This is a good review.

From this detailed description, it is apparent that the individual game board units can have many variations within the structure of the diverse game sets, collectively known as Tutorial Game. It must be understood that, although specific terms are employed in this description, they are used as descriptive and general in nature, and in no way limit this invention. The scope of this invention is to be determined solely by the claims as set forth below.

I claim:

1. A game apparatus that embodies, in combination, a game board containing printed matter, pictures, maps, diagrams, and/or other subject matter designed to help players with responses, wherein some responses and/or methods of arriving at some responses are contained on said game board; cards that primarily contain any combinations of a question, questions, a command, commands, a symbol, symbols, a name, and/or names on one side of the card, with the matching and required answer, answers, statement, statements, word, words, name, and/or names on the reverse side of the same card, the questions, etc., and answers, etc., on said cards being at least in part related to the printed matter on said game board.

2. A game apparatus that embodies a game board, with a peripheral area containing a closed rectangular path constituting a continuous playing course; playing tokens; the squares comprising the playing course being individually identified and arranged in a repeated sequence, the identification indicating that the player is to respond by supplying the required answer, statement, word, and/or name to a question, command, symbol, and/or name on the top card from a specific set of cards, and the course being interrupted by squares which indicate a forfeiture of turn; the game board embodying an enclosed central area which is designed to help the player with responses and containing printed matter, pictures, diagrams, and other subject matter; the game apparatus embodying a plurality of card sets placed between the peripheral area and the enclosed central area of the game board, each card within a set of cards being marked with the same identification, corresponding to an identification on the playing course, each set of cards being marked with a different identification to distinguish it from the other sets of cards; the questions, commands, symbols, and/or names on the cards forming a progression from least difficult to most difficult within the game board unit; the matching and required response or responses being located on the reverse side of the same card.

3. A game apparatus that embodies a plurality of diverse game board units, each embodying the features recited in claim 2 for a single game board unit; the questions, commands, symbols, and/or names on the cards forming a progression from least difficult to most difficult within at least some of the game board units that comprise the game apparatus.

4. A game apparatus that embodies diverse game sets, each embodying a plurality of diverse game board units in accordance with claim 3, wherein each game set is limited to one subject but all game sets are designed using the same system.

* * * * *